United States Patent [19]

Scanni et al.

[11] 3,931,700

[45] Jan. 13, 1976

[54] SURFACES PRODUCED BY INTERLOCKING MEMBERS

[75] Inventors: Nino V. Scanni; Iberio E. Scanni, both of Edmonton, Canada

[73] Assignee: The Raymond Lee Organization, Inc., New York, N.Y. ; a part interest

[22] Filed: Aug. 16, 1974

[21] Appl. No.: 497,924

[52] U.S. Cl. ..... 52/590; 404/41; 403/339

[51] Int. Cl.[2] ..... E01C 5/00

[58] Field of Search ..... 52/590, 593, 608; 404/41; 403/339, 340

[56] References Cited

UNITED STATES PATENTS

| | | | |
|---|---|---|---|
| 470,377 | 3/1892 | Graham | 404/41 |
| 888,530 | 5/1908 | Pugh | 52/590 |
| 1,969,729 | 8/1934 | Damianik | 404/41 |
| 3,602,111 | 8/1971 | Clemente | 404/41 |

FOREIGN PATENTS OR APPLICATIONS

| | | | |
|---|---|---|---|
| 921,289 | 1/1947 | France | 404/41 |
| 994,265 | 8/1951 | France | 404/41 |
| 512,277 | 7/1952 | Belgium | 404/41 |
| 1,486,955 | 5/1967 | France | 404/41 |

*Primary Examiner*—Andrew V. Kundrat

[57] ABSTRACT

A member which when disposed in a plane in abutting relationship with a plurality of other members defines a planar surface which will remain flat when pressure is applied along the thickness from two opposed directions. The member takes the form of a body having upper and lower flat parallel main faces joined by six curved side faces disposed end to end defining and endless closed path. The upper main face has a periphery of six sections disposed end to end, these sections defining like arcs with like radii of curvature but being alternately convex and concave. The lower main face identical to the upper main but is rotated through 60° of arc with respect thereto to insure that the end points of each concave arc section of either main face are vertically aligned with the corresponding end points of the corresponding convex arc section of the other main face. Each concave section together with its said corresponding convex section and the aligned end points of both said sections defines a corresponding one of said side faces.

1 Claim, 7 Drawing Figures

SURFACES PRODUCED BY INTERLOCKING MEMBERS

SUMMARY

The object of the invention is to provide a flat surface which will remain flat under tensions and expansions of various kinds and which can be kept merely by applying pressure along its thickness from two opposed directions, without the use of reinforcements embedded in the surface.

Thus, a plurality of like interlocking members are formed. Each member has two parallel flat faces which will form the flat surface when the member is interlocked with others of its kind.

Six curved side faces form the sides of the member, the curved pieces being disposed in a ring between the flat faces. The non-flat faces bulge alternately inwardly and outwardly in the ring, and engage corresponding outwardly and inwardly bulging faces on neighboring members. Because of the engagement of the curved side faces, no one member may be removed from the surface without removing the neighboring members engaged therewith, and the whole surface must thus be moved as a unit, or none of it may be moved at all. The surface is kept flat by pressure along the thickness of the member from two opposed sources, which keeps the side faces of one member tightly engaged with the side faces of neighboring members.

DETAILED DESCRIPTION

Figure 1:
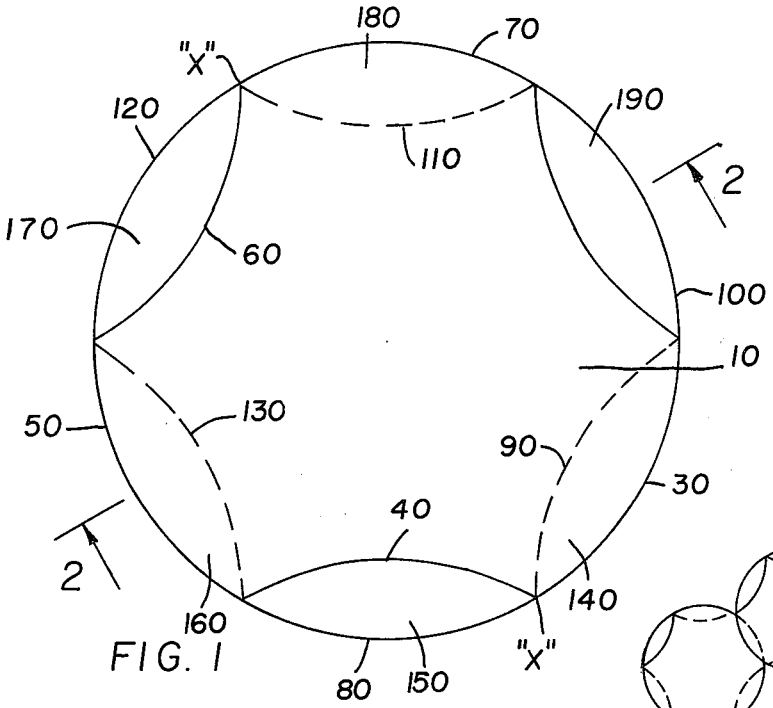
FIG. 1 is a top view of one of the members.
Figure 3:
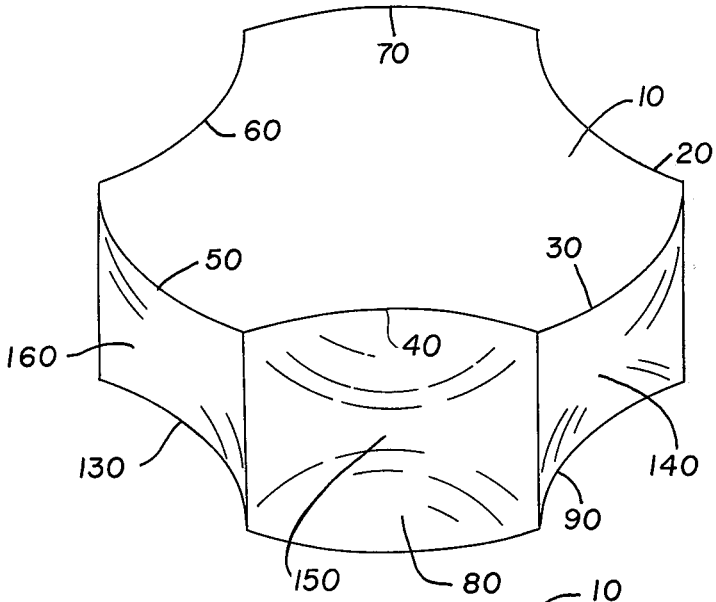
FIG. 3 is another view of the member shown in FIGS. 1 and 2.
Figure 2:
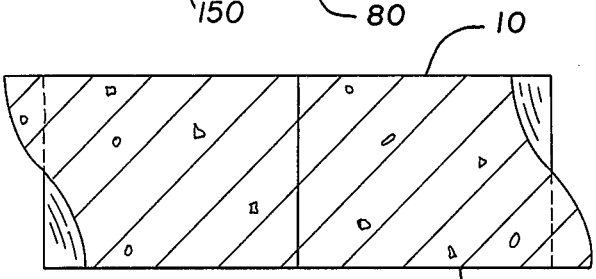
FIG. 2 is a view along line 2—2 of FIG. 1.

Referring to FIGS. 1–3, a member has a top flat face 10 with a periphery formed by six arcs 20, 30, 40, 50, 60, 70, all of which are of equal length and radius of curvature. The arcs form a ring, with convex arcs 30, 50 and 70 bulging away from the center of the face, and concave arcs 20, 40 and 60 being oppositely directed.

Below this face and parallel to it is a bottom flat face 75 which is congruent to top face 10 but which is rotated 60° of arc with respect to it. Thus, arcs 80, 90, 100, 110, 120 and 130 have their endpoints directly below the end-points of arcs which are oppositely directed. Thus, curved side faces 140, 150, 160, 170, 180 and 190 are formed, by the collection of straight lines that connect corresponding points on the peripheries of the two flat faces. These lines have varying vertical slopes decreasing from infinite values when they extend between endpoints to a minimum when they extend between midpoints of corresponding arcs.

Figure 4:
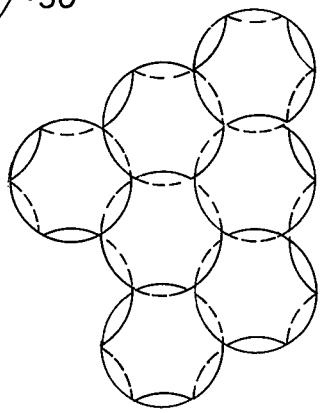
FIG. 4 exhibits the interlocking action of a plurality of members of the type shown in FIG. 1.

As is shown in FIG. 4, the member forms a flat surface when interlocked with others of its kind.

Figure 5:
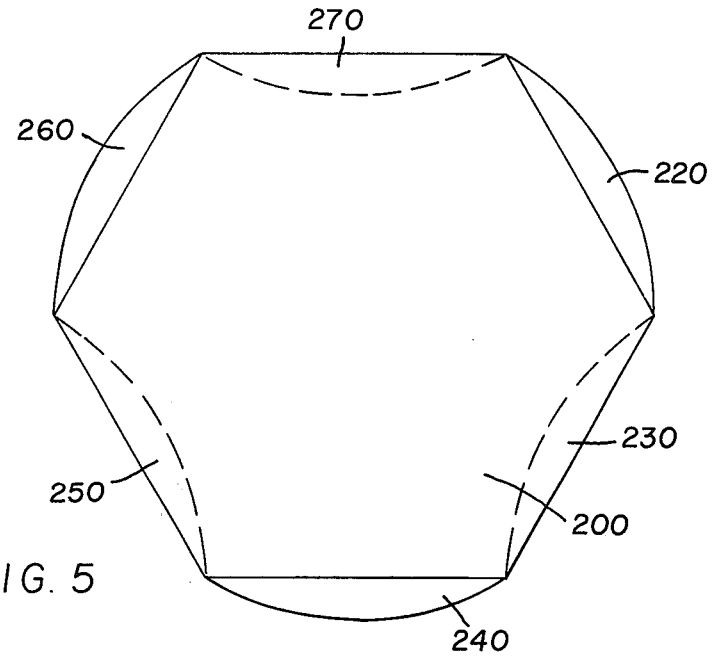
FIG. 5 is a top view of a second type of member.
Figure 6:
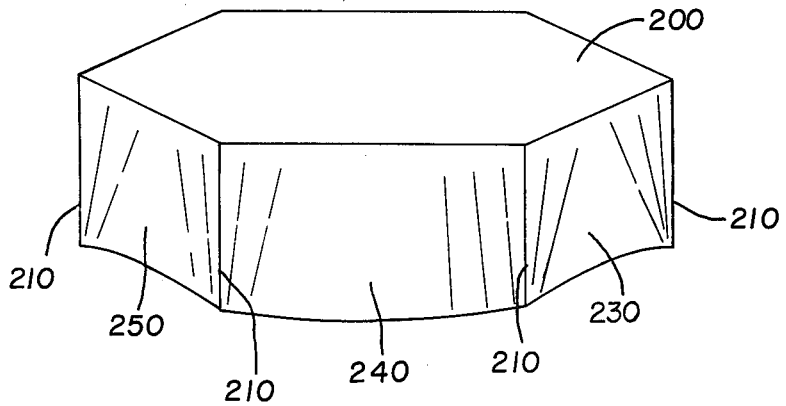
FIG. 6 is another view of the member of FIG. 5.

Referring now to FIGS. 5 and 6, another member is shown which functions in a similar manner although it is shaped differently. One face 200 (which can be either the top or bottom) takes on the shape of a hexagon, and the opposite face has the same shape as in FIGS. 1–3. The faces are aligned in the same manner as before. Thus, the altitudes 210 connecting corresponding vertices of the top and bottom faces form rectangular peripheries of side faces 220, 230, 240, 250, 260 and 270. These faces alternately bulge inwardly (as in faces 230, 250 and 270) towards the centers of the top and bottom faces, or outwardly, as in faces 240, 260, and 220, forming a ring. As before, the inwardly bulging faces engage outwardly bulging faces of neighboring units, and vice versa.

Figure 7:
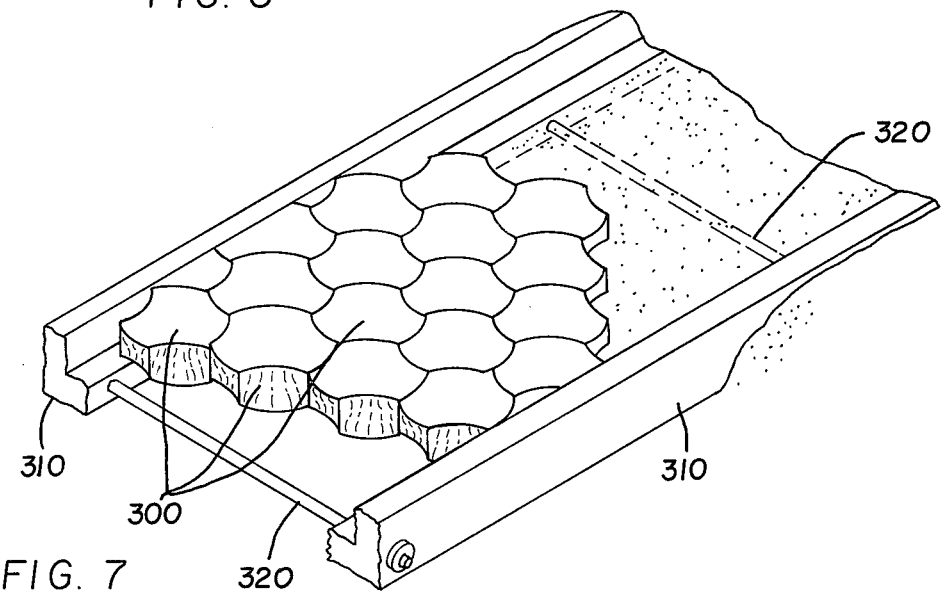
FIG. 7 exhibits the interlocking action of members of the type shown in FIG. 5.

FIG. 7 shows how a surface formed from the members may be constructed. A plurality of interlocked members 300 are pressed together by transverse iron bars 320. None of the pieces may be removed individually, and thus a rigid flat surface is formed without bars being embedded in it.

The pieces can be formed of wood, plastic or any other suitable material.

While the invention has been described with particular reference to the drawings, the protection is to be limited only by the terms of the claims which follow.

We claim:

1. A member which when located in a plane in abutting relationship with a plurality of other like members defines a planar surface which will remain flat when pressure is applied along the thickness of the surface from two opposed directions, the member comprising:

a body having upper and lower flat, parallel main faces joined by six curved side faces that are connected end to end to define an endless closed path, the upper main face having a periphery of six sections connected end to end, the sections defining congruent circular arcs that are alternately concave and convex, the lower main face being identical to the upper main face but being rotated through 60° of arc with respect to it to vertically align the endpoints of the sections so that the endpoints of each concave section in each main face is vertically aligned with the endpoints of a corresponding convex section in the other main face, each concave section, its corresponding convex section and their vertically aligned endpoints defining the periphery of one of the curved side faces, and each side face being further defined by the collection of straight lines of varying vertical slope which extend between corresponding points on each corresponding pair of sections, said lines having an infinite slope at the endpoints and having steadily decreasing slopes as their distance to the midpoints of the sections decreases.

* * * * *